US007819779B2

(12) United States Patent
Chang

(10) Patent No.: US 7,819,779 B2
(45) **Date of Patent: *Oct. 26, 2010**

(54) COMBINATION OF TREADMILL AND STAIR CLIMBING MACHINE

(75) Inventor: Dick Chang, Shen Kang Hsiang (TW)

(73) Assignee: Nautilus, Inc., Vancouver, WA (US)

( * ) Notice: Subject to any disclaimer, the term of this patent is extended or adjusted under 35 U.S.C. 154(b) by 299 days.

This patent is subject to a terminal disclaimer.

(21) Appl. No.: 11/425,086

(22) Filed: Jun. 19, 2006

(65) Prior Publication Data

US 2006/0223680 A1 Oct. 5, 2006

Related U.S. Application Data

(63) Continuation of application No. 10/637,628, filed on Aug. 11, 2003, now Pat. No. 7,097,593.

(51) Int. Cl.
*A63B 22/02* (2006.01)
*A63B 22/04* (2006.01)

(52) U.S. Cl. ..... 482/54; 482/52

(58) Field of Classification Search ..... 482/51–54
See application file for complete search history.

(56) References Cited

U.S. PATENT DOCUMENTS

| | | | | |
|---|---|---|---|---|
| 964,898 | A | 7/1910 | Budingen | |
| 2,434,760 | A | 1/1948 | Eggleston | |
| 3,408,067 | A | 10/1968 | Armstrong | |
| 3,580,340 | A * | 5/1971 | Brown | 172/126 |
| 3,792,860 | A | 2/1974 | Selnes | |
| 3,814,420 | A | 6/1974 | Encke | |
| 4,204,673 | A | 5/1980 | Speer, Sr. | |
| 4,423,864 | A | 1/1984 | Wiik | |
| 4,555,108 | A | 11/1985 | Monteiro | |

(Continued)

FOREIGN PATENT DOCUMENTS

| | | |
|---|---|---|
| AU | 233194 | 8/1959 |

(Continued)

OTHER PUBLICATIONS

Catalog, Diamond House International Inc., date unknown.

(Continued)

*Primary Examiner*—Steve R Crow
(74) *Attorney, Agent, or Firm*—Dorsey & Whitney LLP

(57) ABSTRACT

A combination of treadmill and stair climbing machine includes a single roller supported on a shaft between two lugs on two sides of the frame of the combination and two rear ends of two pedals are respectively connected to the roller and supported on the two lugs. Two front ends of the two pedals are respectively connected to two hydraulic cylinders. A switch member is pivotably connected to a front end of the frame and can be set in a horizontal position when the combination is used as stair climbing machine, and an inclined position when the combination is used as treadmill. An L-shaped plate is connected to the frame and each pedal has a connection plate which has two elongate holes in which two protrusions on each side of the L-shaped plate are movably engaged, such that the pedals are pivotably supported on the L-shaped plate when used as stair climbing machine.

23 Claims, 15 Drawing Sheets

U.S. PATENT DOCUMENTS

| | | | | |
|---|---|---|---|---|
| 4,659,077 | A | 4/1987 | Stropkay | |
| 4,733,858 | A | 3/1988 | Lan | |
| 4,747,612 | A * | 5/1988 | Kuhn | 172/275 |
| 4,830,362 | A | 5/1989 | Bull | |
| 4,974,831 | A | 12/1990 | Dunham | |
| 5,039,088 | A | 8/1991 | Shifferaw | |
| 5,054,770 | A | 10/1991 | Bull | |
| 5,135,447 | A | 8/1992 | Robards, Jr. | |
| 5,139,255 | A | 8/1992 | Sollami | |
| 5,207,621 | A | 5/1993 | Koch et al. | |
| 5,226,866 | A | 7/1993 | Engel et al. | |
| 5,263,910 | A | 11/1993 | Yang | |
| 5,282,776 | A | 2/1994 | Dalebout | |
| 5,299,993 | A * | 4/1994 | Habing | 482/52 |
| 5,336,146 | A * | 8/1994 | Piaget et al. | 482/54 |
| 5,338,273 | A | 8/1994 | Metcalf | |
| 5,372,560 | A | 12/1994 | Chang | |
| 5,385,520 | A | 1/1995 | Lepine et al. | |
| 5,431,612 | A | 7/1995 | Holden | |
| 5,441,467 | A | 8/1995 | Stevens | |
| 5,460,586 | A | 10/1995 | Wilkinson et al. | |
| 5,490,818 | A | 2/1996 | Haber et al. | |
| 5,492,517 | A | 2/1996 | Bostic | |
| 5,509,872 | A | 4/1996 | Chen | |
| 5,538,489 | A | 7/1996 | Magid | |
| 5,626,539 | A * | 5/1997 | Piaget et al. | 482/54 |
| 5,679,101 | A | 10/1997 | Magid | |
| 5,690,582 | A | 11/1997 | Ulrich et al. | |
| 5,733,228 | A | 3/1998 | Stevens | |
| 5,803,871 | A | 9/1998 | Stearns et al. | |
| 5,803,874 | A | 9/1998 | Wilkinson | |
| 5,879,271 | A | 3/1999 | Stearns | |
| 5,951,449 | A | 9/1999 | Oppriecht | |
| 5,967,944 | A | 10/1999 | Vittone | |
| 5,993,358 | A | 11/1999 | Gureghian et al. | |
| 6,033,344 | A | 3/2000 | Frank et al. | |
| 6,042,513 | A | 3/2000 | Koteles et al. | |
| 6,042,519 | A | 3/2000 | Shea | |
| 6,045,490 | A | 4/2000 | Shafer et al. | |
| 6,283,896 | B1 | 9/2001 | Grunfeld et al. | |
| 6,409,633 | B1 | 6/2002 | Abelbeck | |
| 6,454,679 | B1 | 9/2002 | Radow | |
| 6,461,279 | B1 * | 10/2002 | Kuo | 482/54 |
| 6,645,124 | B1 | 11/2003 | Clem | |
| 6,811,519 | B2 | 11/2004 | Kuo | |
| 6,824,502 | B1 | 11/2004 | Huang | |
| 6,849,034 | B2 | 2/2005 | Eschenbach | |
| 6,893,383 | B1 | 5/2005 | Chang et al. | |
| 6,902,513 | B1 | 6/2005 | McClure | |
| 6,923,746 | B1 | 8/2005 | Skowronski et al. | |
| D521,577 | S | 5/2006 | Wu | |
| 7,097,593 | B2 | 8/2006 | Chang | |
| 7,163,493 | B1 | 1/2007 | Kuo | |
| 7,166,062 | B1 | 1/2007 | Watterson | |
| 7,179,204 | B2 | 2/2007 | Anderson et al. | |
| 7,306,546 | B2 | 12/2007 | Lo | |
| 7,377,882 | B2 | 5/2008 | Watterson et al. | |
| 2001/0016542 | A1 | 8/2001 | Yoshimura | |
| 2003/0064862 | A1 | 4/2003 | Hald et al. | |
| 2004/0192514 | A1 | 9/2004 | Piaget et al. | |
| 2004/0214693 | A1 | 10/2004 | Piaget et al. | |
| 2005/0202939 | A1 | 9/2005 | Lull et al. | |
| 2005/0209059 | A1 | 9/2005 | Crawford et al. | |
| 2005/0209060 | A1 | 9/2005 | Lull | |
| 2005/0209061 | A1 | 9/2005 | Crawford et al. | |
| 2005/0233864 | A1 | 10/2005 | Smith et al. | |
| 2005/0245359 | A1 | 11/2005 | Lo | |
| 2008/0070758 | A1 | 3/2008 | Lull et al. | |
| 2009/0264260 | A1 | 10/2009 | Piaget et al. | |
| 2010/0062904 | A1 | 3/2010 | Crawford et al. | |
| 2010/0075812 | A1 | 3/2010 | Piaget et al. | |

FOREIGN PATENT DOCUMENTS

| | | | |
|---|---|---|---|
| CN | 2510102 | Y | 9/2002 |
| CN | 2675190 | Y | 2/2005 |
| EP | 1316332 | | 6/2003 |
| SU | 1 265 113 | A1 | 10/1986 |
| TW | 367860 | | 2/1999 |
| TW | 381497 | | 2/1999 |
| TW | 375944 | | 4/1999 |
| TW | 472593 | | 1/2002 |
| TW | 515306 | Y | 12/2002 |
| TW | 547102 | Y | 8/2003 |
| TW | M249682 | | 11/2004 |
| WO | WO 95/16502 | A1 | 6/1995 |
| WO | WO 99/21620 | A1 | 5/1999 |
| WO | WO 01/58534 | A1 | 8/2001 |
| WO | WO 2004/108225 | A1 | 12/2004 |

OTHER PUBLICATIONS

"Nautilus Home Health & Fitness Catalog", Nautilus, Inc., pp. 1-56 (2004).

Notice of Allowance, U.S. Appl. No. 11/065,770, Oct. 9, 2009, 2 pages.

Amendment and Response Filed With RCE, U.S. Appl. No. 11/065,770, Sep. 1, 2009, 12 pages.

Advisory Action, U.S. Appl. No. 11/065,770, Aug. 18, 2009, 6 pages.

Amendment and Response to Final Office Action Under 37 C.F.R. 1.116, U.S. Appl. No. 11/065,770, Aug. 3, 2009, 7 pages.

Final Office Action, U.S. Appl. No. 11/065,770, Jun. 1, 2009, 8 pages.

Amendment and Response to Office Action, U.S. Appl. No. 11/065,770, Mar. 16, 2009, 11 pages.

Non-Final Office Action and Notice of References Cited (PTO-892), U.S. Appl. No. 11/065,770, Oct. 14, 2008, 7 pages.

Response to Election Requirement, U.S. Appl. No. 11/065,770, Jul. 31, 2008, 3 pages.

Restriction/Election Requirement, U.S. Appl. No. 11/065,770, Jun. 3, 2008, 5 pages.

Notice of Allowance, U.S. Appl. No. 10/637,628, Feb. 27, 2006, 4 pages.

Notice of Allowance, U.S. Appl. No. 10/637,628, Sep. 8, 2005, 4 pages.

Notice of Allowance, U.S. Appl. No. 10/637,628, Mar. 8, 2005, 4 pages.

Amendment and Response to Sep. 8, 2004 Office Action, U.S. Appl. No. 10/637,628, Feb. 8, 2005, 5 pages.

Non-Final Office Action and Notice of References Cited (Form PTO-892), U.S. Appl. No. 10/637,628, Sep. 8, 2004, 6 pages.

Preliminary Amendment, U.S. Appl. No. 10/637,628, Aug. 23, 2004, 10 pages.

* cited by examiner

COMBINATION OF TREADMILL AND STAIR CLIMBING MACHINE

CROSS REFERENCE TO RELATED APPLICATION

This application is a continuation of U.S. application Ser. No. 10/637,628, filed on Aug. 11, 2003 and entitled "Combination of Treadmill and Stair Climbing Machine", which is hereby incorporated by reference as if fully disclosed herein.

FIELD OF THE INVENTION

The present invention relates to a combination of treadmill and stair climbing machine, and the combination requires only simple mechanism which effectively reduces manufacturing cost.

BACKGROUND OF THE INVENTION

A conventional combination "A" of treadmill and stair climbing machine is shown in FIGS. 6, 6A, 6B and 6C, and generally includes a frame 50 with two posts 20 connected to two sides of a front end of the frame 50 and a U-shaped handle 30 is connected to the two posts 20. Two rollers 70 are connected to a rear end of the frame 50 and driven by a wheel 71 which is driven by a motor "C". An L-shaped plate 9 is connected to the rear end of the frame 50 and supports the shafts of the two rollers 70. Two pedals 10 respectively connected to the two rollers 70 and each pedals 10 has a running belt "B" reeving the roller 70 and a front end of the pedal 10. Two hydraulic cylinders 40 are respectively connected between the two pedals 10 and two connection ports 41 on the two posts 20. Each pedal 10 has an extension 8 connected to an underside thereof and a swing mechanism 80 is connected to the two pedals 10 so that when the combination is set to be a stair climbing machine as shown in FIG. 6A, the two pedals 10 can be alternately stepped downward at the front end thereof. A T-shaped switch member 1 is connected to the front end of the frame 50 and one of two ends of its transverse bar is pivotably connected to a link 3 which is connected to a support frame 4 on which two support pieces 5 are located. Two springs 6 are respectively connected between the two support pieces 5 and the frame 50. Each extension 8 has a block 7 connected to a distal end thereof so that when operating the T-shaped switch member 1 to the position as shown in FIG. 6, the blocks 7 are supported on the support pieces 5. At this position, the two pedals 10 cannot be pivoted about the rollers 70 and are used as a treadmill.

It is noticed that the structure for transferring the treadmill and stair climbing machine, including the T-shaped switch member 1, the link 3, the support frame 4, the support pieces 5, the blocks 7, and the extensions 8, is too complicated and costly. Besides, the two pedals 10 are supported by the rollers 70 which are easily to be off-centered and this could damage the motor "C".

SUMMARY OF THE INVENTION

In accordance with one aspect of the present invention, there is provided a combination of treadmill and stair climbing machine, and the combination comprises a frame with two posts extending from two sides thereof and a handle is connected between the two posts. Two hydraulic cylinders are connected to the posts and two pedals. Two lugs are connected on the two sides of a rear end of the frame and a roller is connected between the two lugs. A wheel is connected to the roller and driven by a motor.

The two pedals each have a connection plate on a side thereof and the two connection plates are connected to the lugs. Each pedal includes a running belt which reeves through the roller and a front end of each pedal. A switch member is pivotably connected to a U-shaped frame connected to the front end of the frame and the switch member can be optionally positioned at a horizontal position when the two pedals are used as stair climbing machine, and an inclined position when the two pedals are used as a treadmill. A first spring is connected between an underside of the switch member and the frame. A swing mechanism is pivotably connected to the frame and the two pedals.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
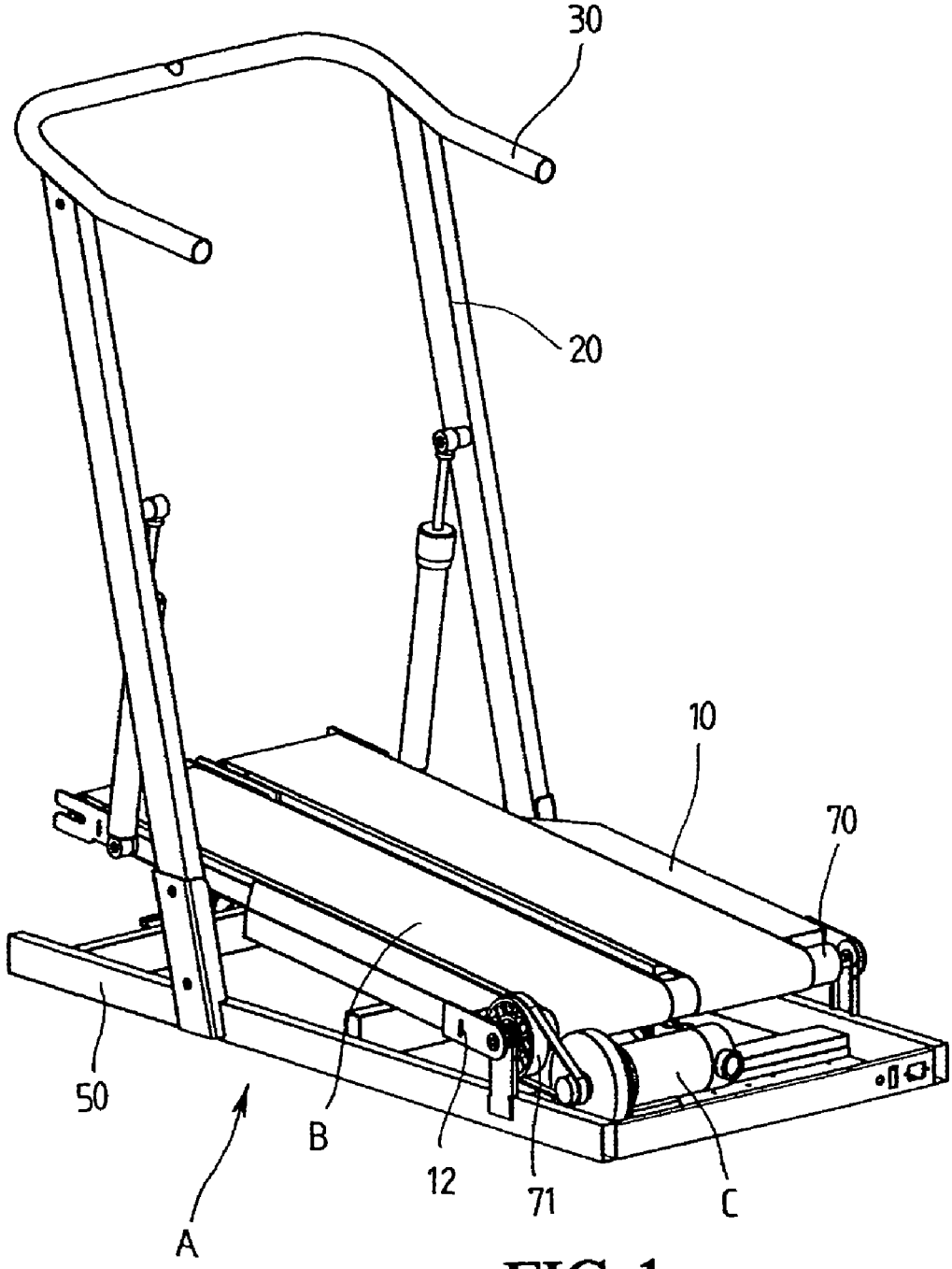
FIG. 1 is a perspective view to show the combination of treadmill and stair climbing machine of the present invention.
Figure 2:
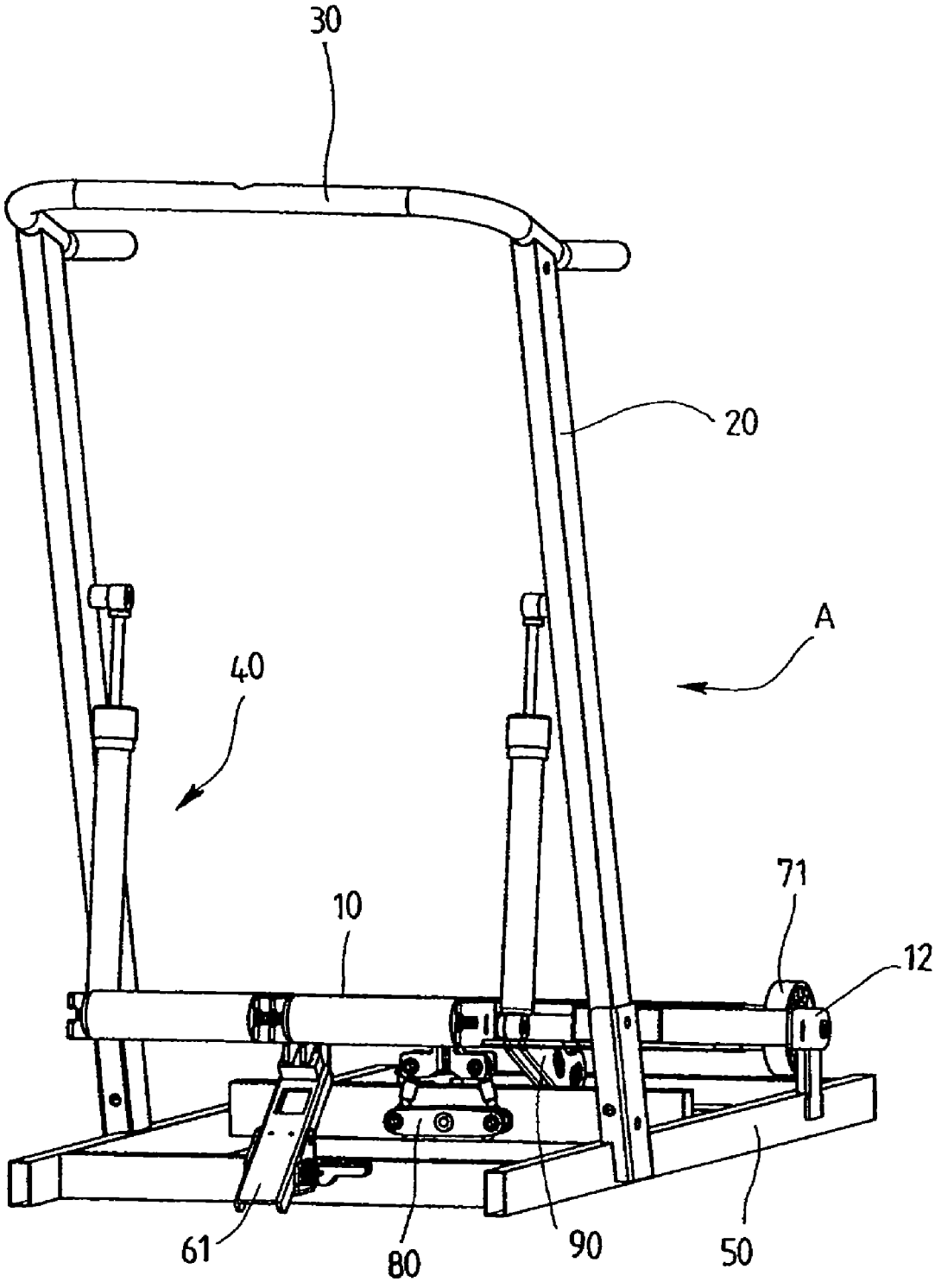
FIG. 2 is a perspective view, viewed from a front end of the combination of treadmill and stair climbing machine of the present invention.

Referring to FIGS. 1, 2, 3 and 3A, the combination "A" of treadmill and stair climbing machine of the present invention comprises a frame 50 with two posts 20 extending from two sides of a front end of the frame 50 and a handle 30 is connected between the two posts 20. Two lugs 54 are connected on the two sides of a rear end of the frame 50 and a roller 70 with a shaft 701 therein is connected between the two lugs 54. A wheel 71 is connected to the roller 70 and driven by a motor "C". An L-shaped plate 53 is connected to a transverse bar 53 of the frame 50 and two protrusions (FIGS. 3B and 3C) extending from each of two sides thereof.

Figure 3:
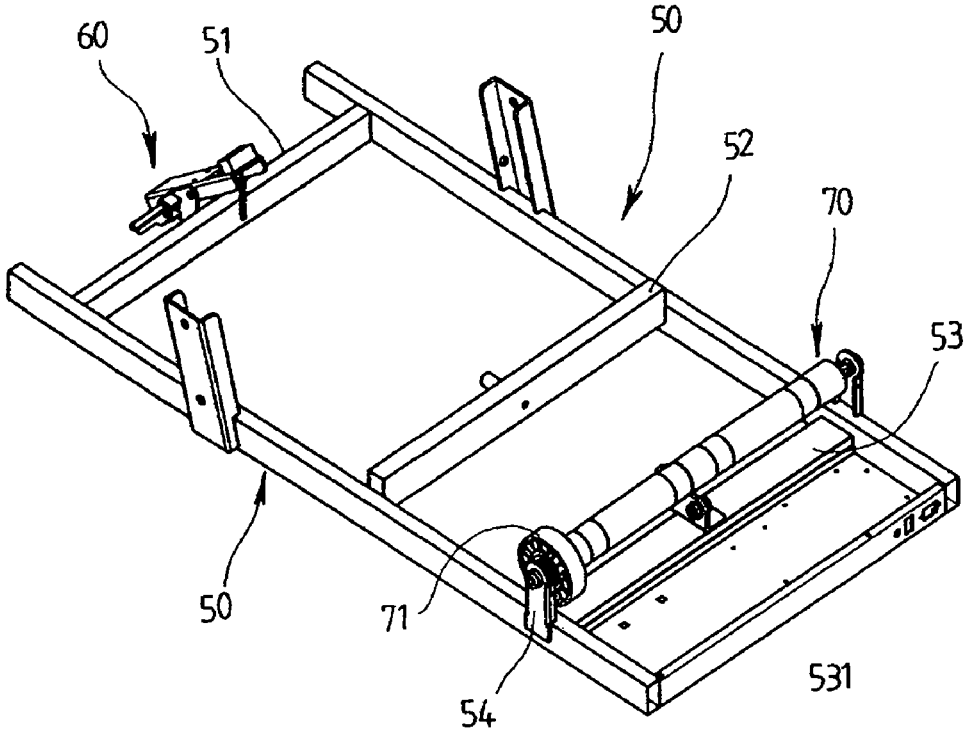
FIG. 3 shows the frame, the roller and the switch member on the frame of the present invention.
Figure 3A:
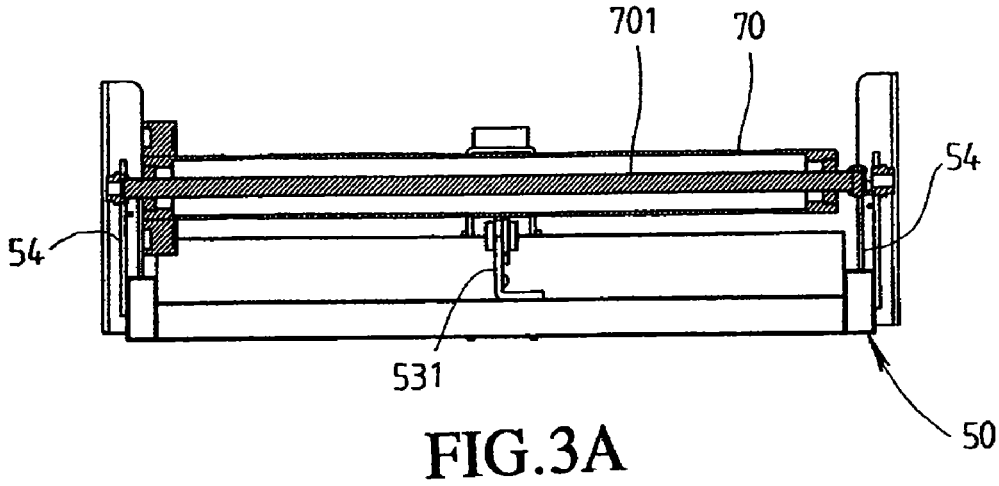
FIG. 3A shows the roller and the shaft in the roller.
Figure 3B:
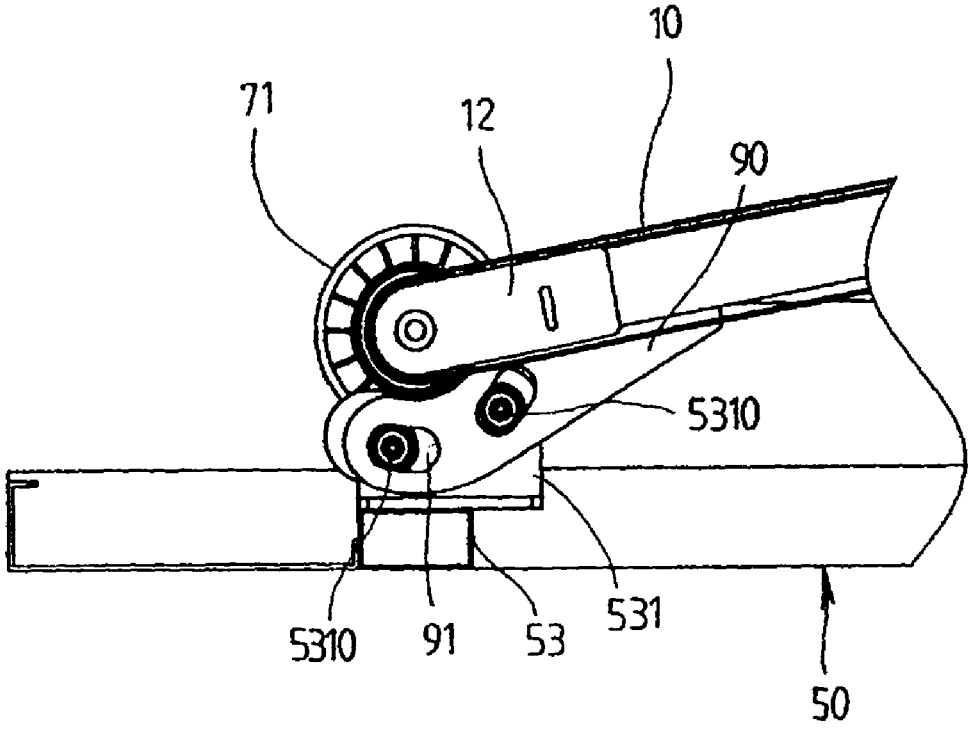
FIGS. 3B and 3C show the protrusions on the L-shaped plate movably engaged with elongate holes in the connection plates of the pedals.
Figure 3C:
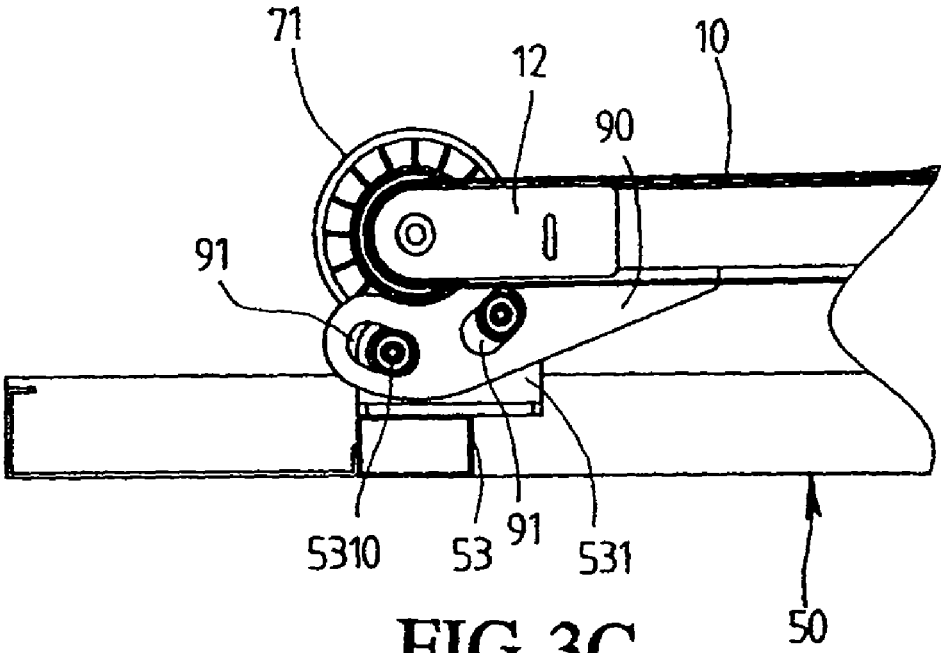

Two pedals 10 each have a connection plate 12 on a side thereof and the two connection plates 12 are connected to the lugs 54. Two hydraulic cylinders 40 are respectively connected between the two posts 20 and the two pedals 10. Each pedal 10 includes a running belt "B" which reeves through the roller 70 and a front end of each pedal 10. Each pedal 10 has a connection plate 90 which has two elongate holes 91 and the two protrusions 5310 are movably engaged with the two elongate holes 91 of each connection plate 90 as shown in FIGS. 3B and 3C when the pedals 10 are set in different function positions.

A switch member 61 is pivotably connected to a U-shaped frame 60 connected to a transverse bar 51 of the front end of the frame 50. The switch member 61 can be positioned at a horizontal position when the two pedals 10 are used as stair climbing machine, and an inclined position when the two pedals 10 are used as a treadmill. A first spring 66 is connected between an underside of the switch member 61 and the frame 50.

Figure 4:
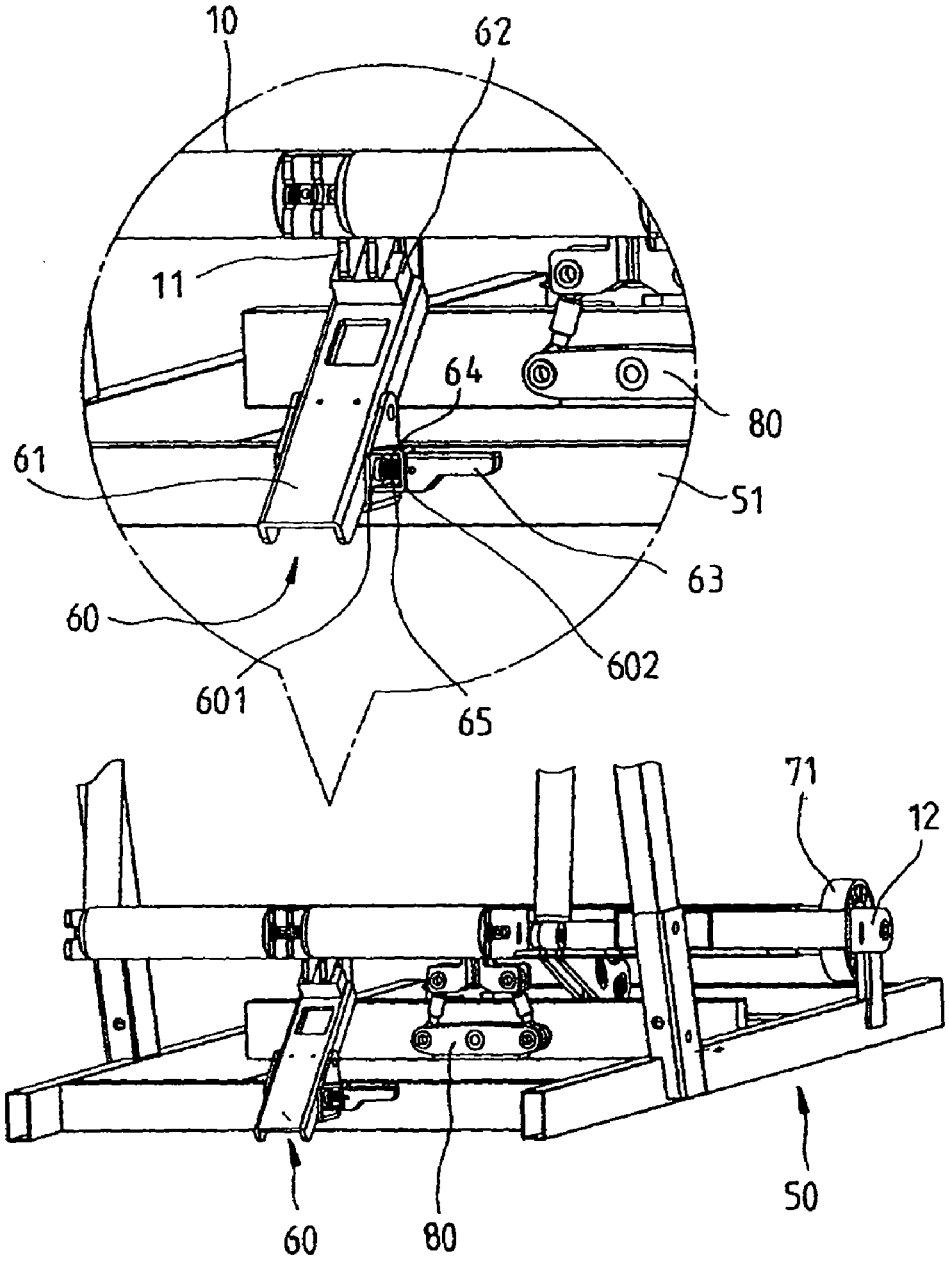
FIG. 4 shows the structure of the switch member and the U-shaped frame.
Figure 4A:
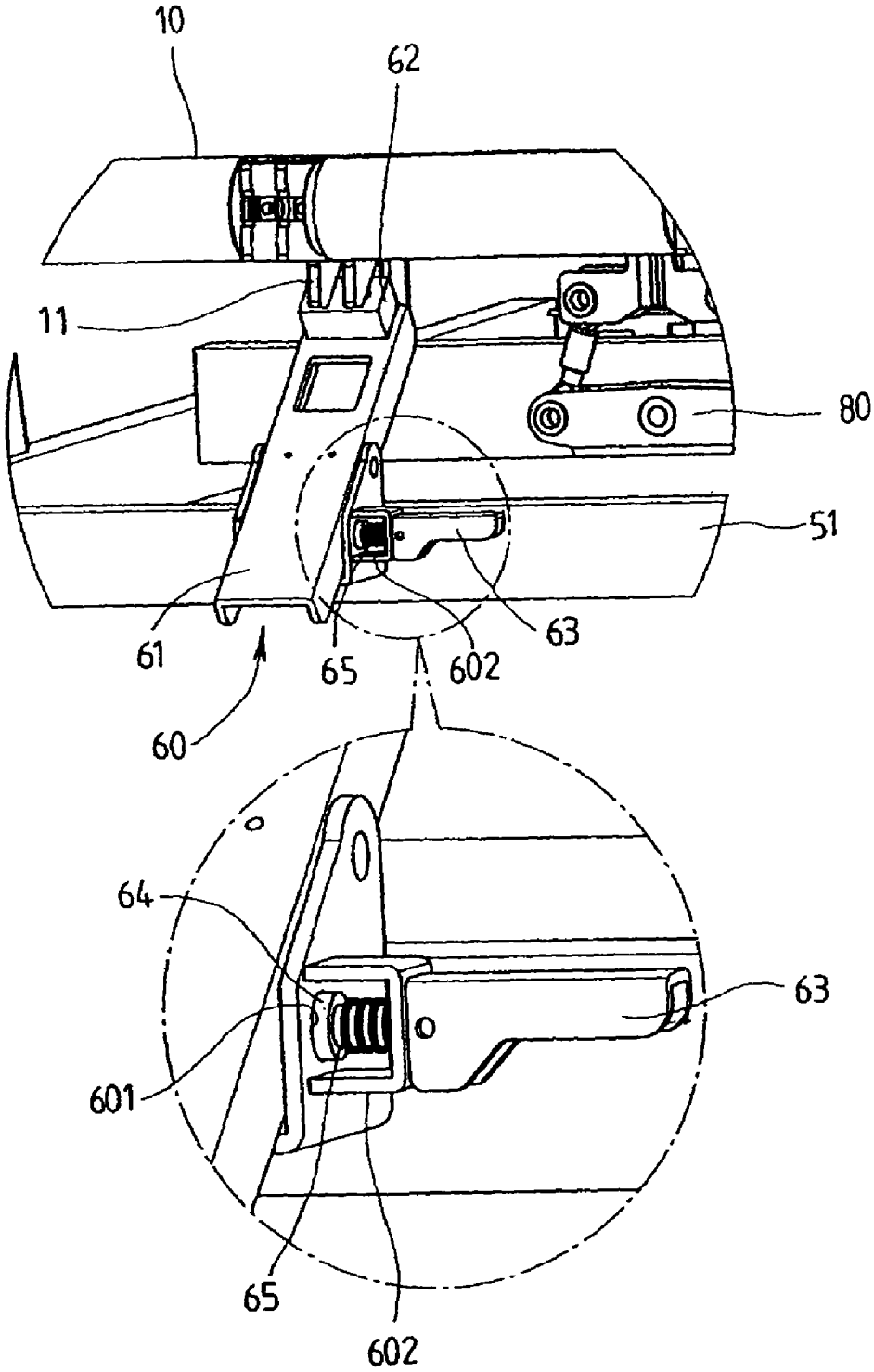
FIG. 4A shows the pin on the handle is inserted in the hole of the switch member.
Figure 4B:
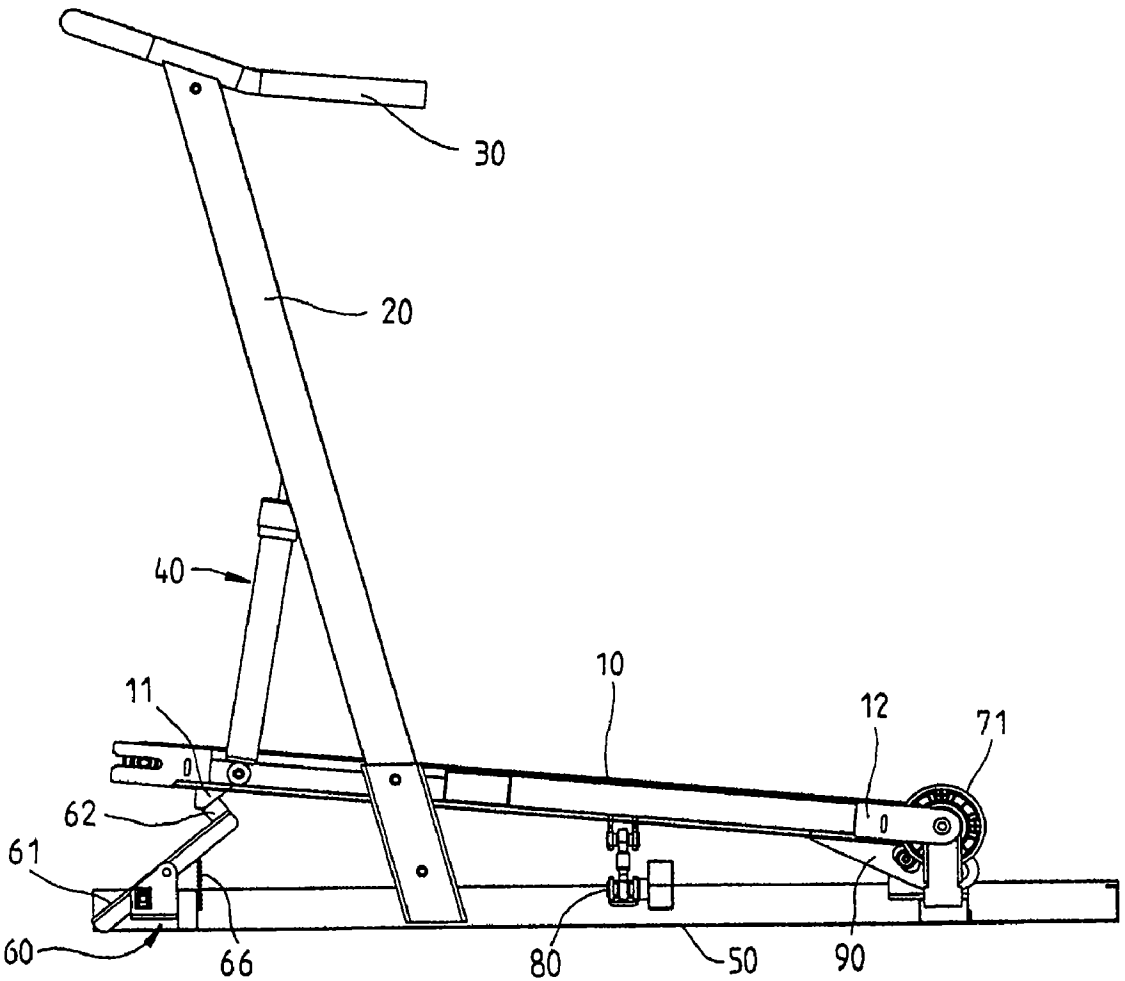
FIG. 4B shows the combination is set as a treadmill.
Figure 5:
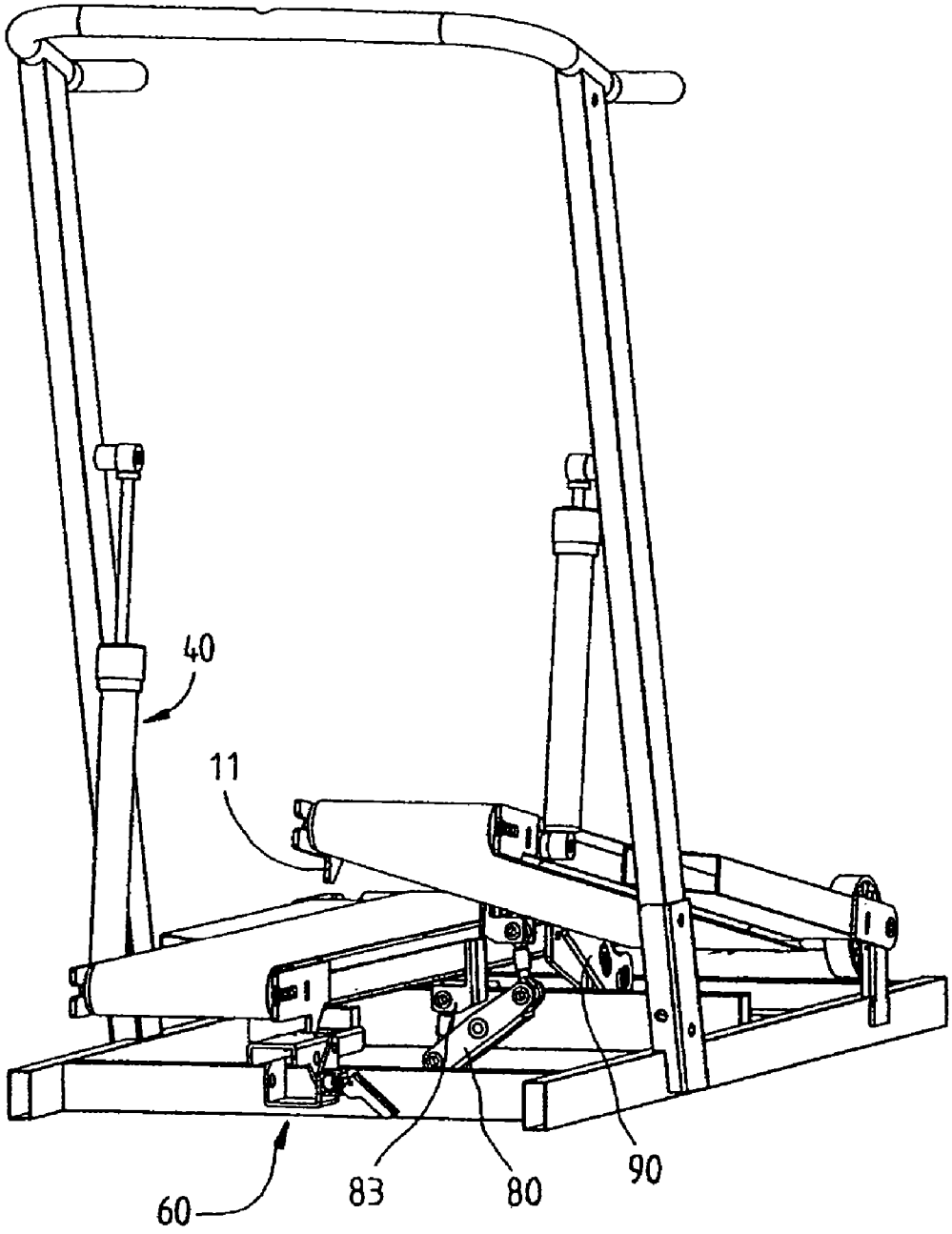
FIG. 5 shows the combination is set as a stair climbing machine.

Further referring to FIGS. 4, 4A, 5, and SA, a sub-frame 602 is connected to a side of one of two side plates of the U-shaped frame 60 and a handle 63 having a cam head is pivotably connected to a pin 64 which extends through the sub-frame 602 and a first hole 601 defined through the side plate of the U-shaped frame 60. A second spring 65 is mounted to the pin 64 and biased between the side plate of the U-shaped frame 60 and the sub-frame. The switch member 61 has an extension which has a second hole 611 defined therethrough, so that the pin 64 can be inserted in the second hole 611 when the switch member 611 is set in the inclined position as shown in FIGS. 4, 4A and 4B. Each pedal 10 includes a tongue 11 on an underside thereof and the support member 10 includes a block 62 on a top thereof. Each tongue 11 includes an inclined side which is rested on a top of the block 62 when the switch member 61 is set in the inclined position.

Figure 5A:
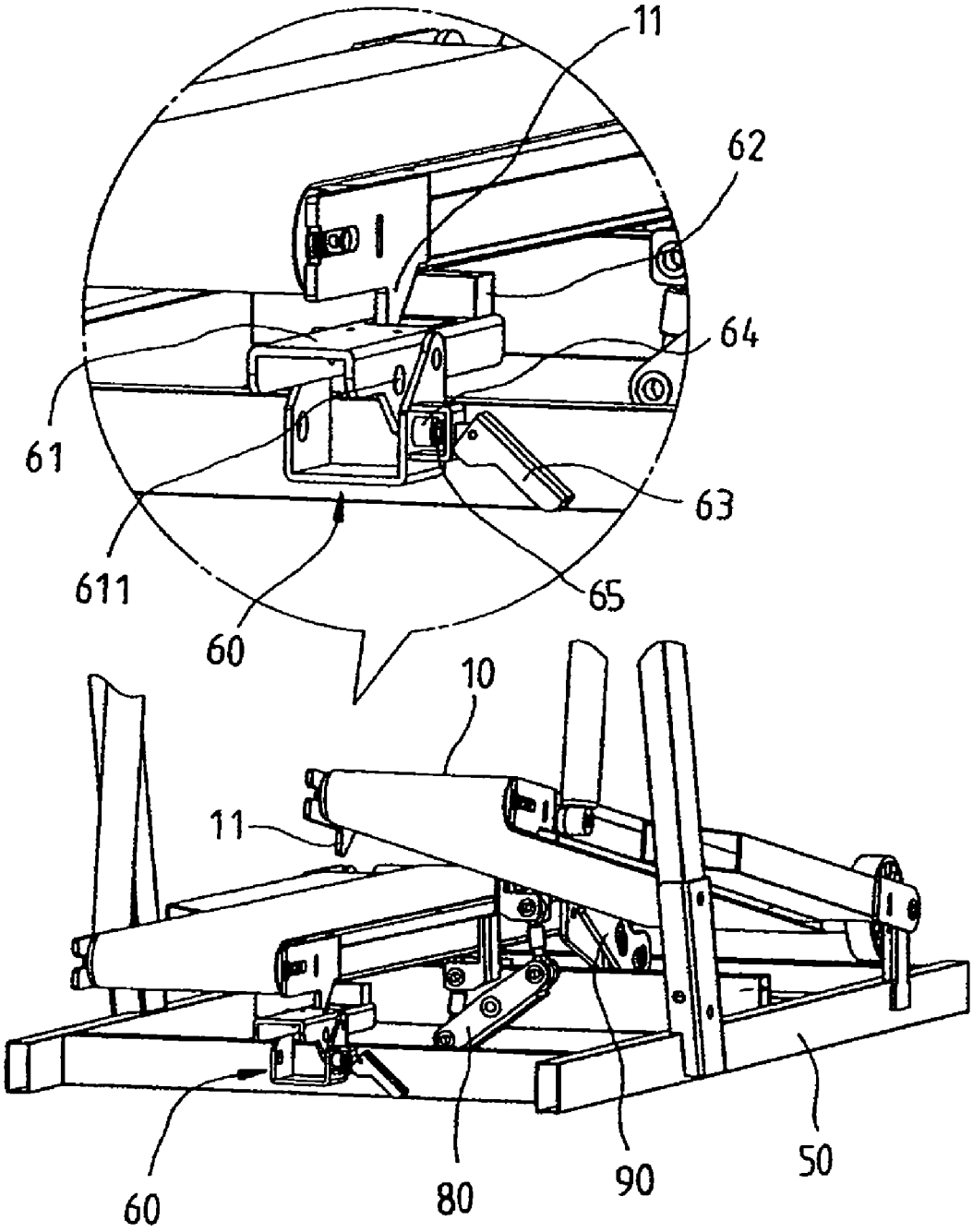
FIG. 5A shows the switch member is set when the combination is set as a stair climbing machine.
Figure 5B:
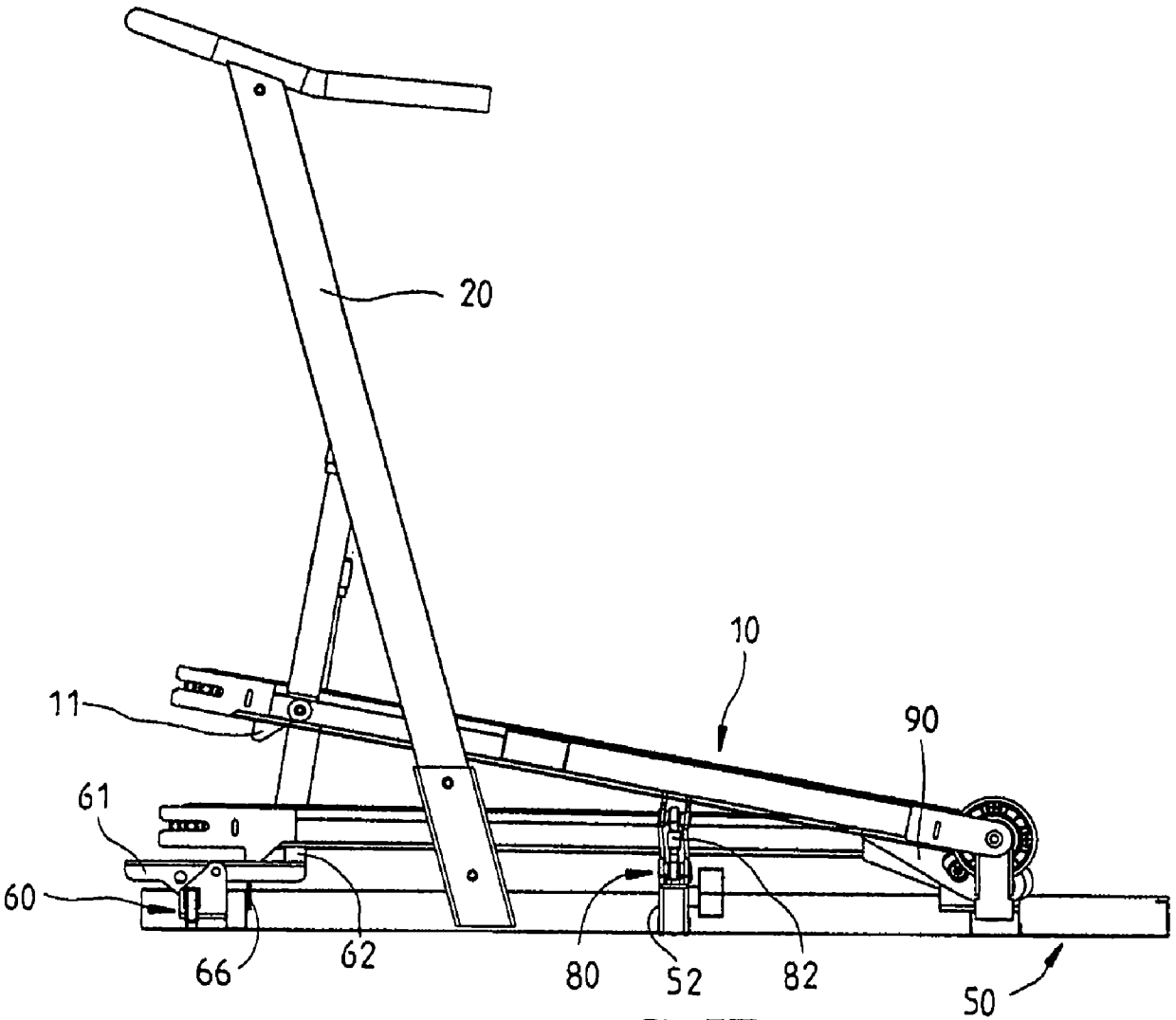
FIG. 5B shows that the combination is set as a stair climbing machine.

As shown in FIGS. 5, 5A and 5B, when the handle 63 are pivoted to pull the pin 64 from the second hole 611 in the switch member 61, and the switch member 61 is pivoted to horizontal position, the spring 66 holds the switch member 61.

Figure 4C:
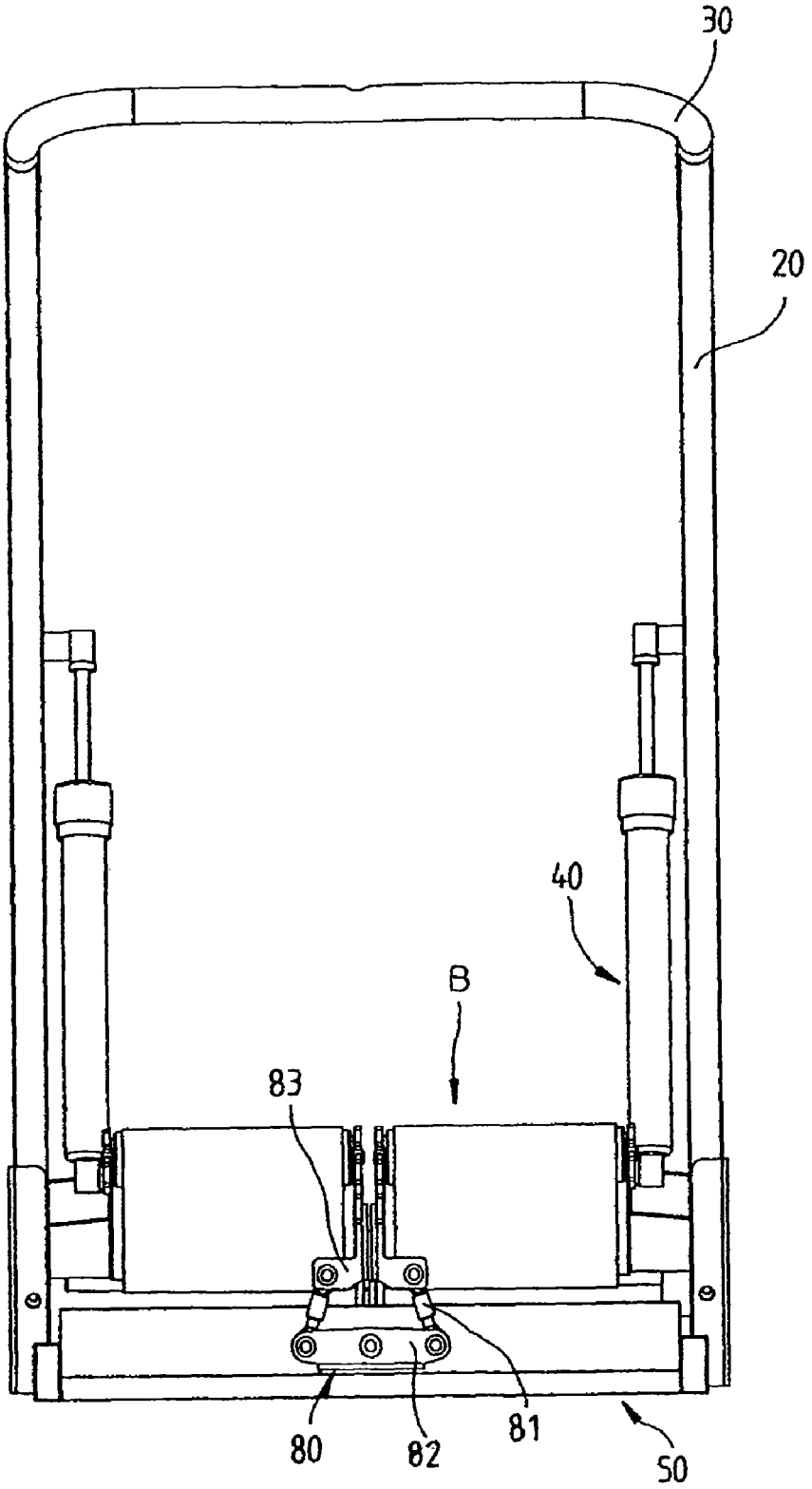
FIG. 4C shows the swing mechanism connected to the two pedals.
Figure 5C:
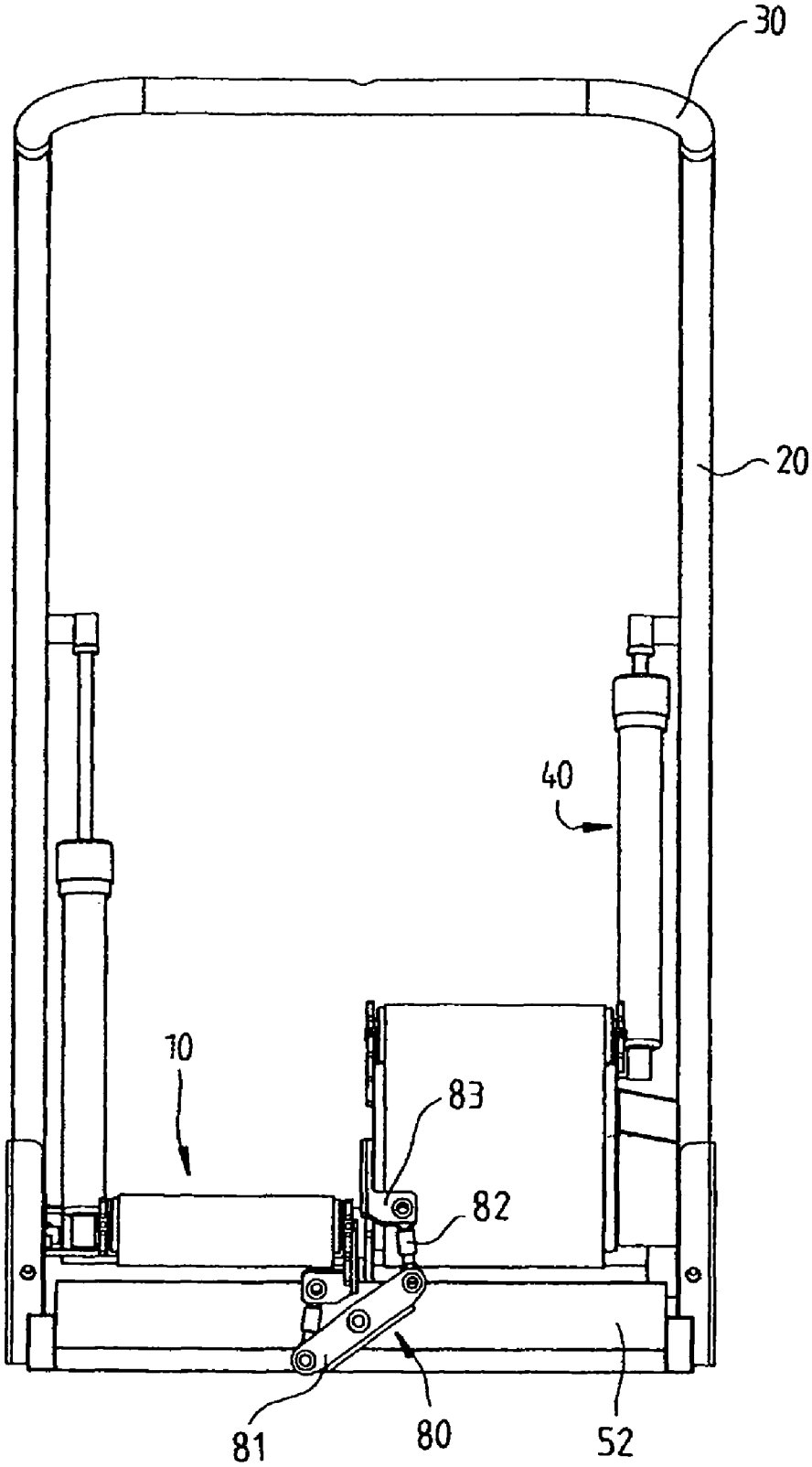
FIG. 5C shows that the swing mechanism is operated when combination is set as a stair climbing machine.
Figure 6:
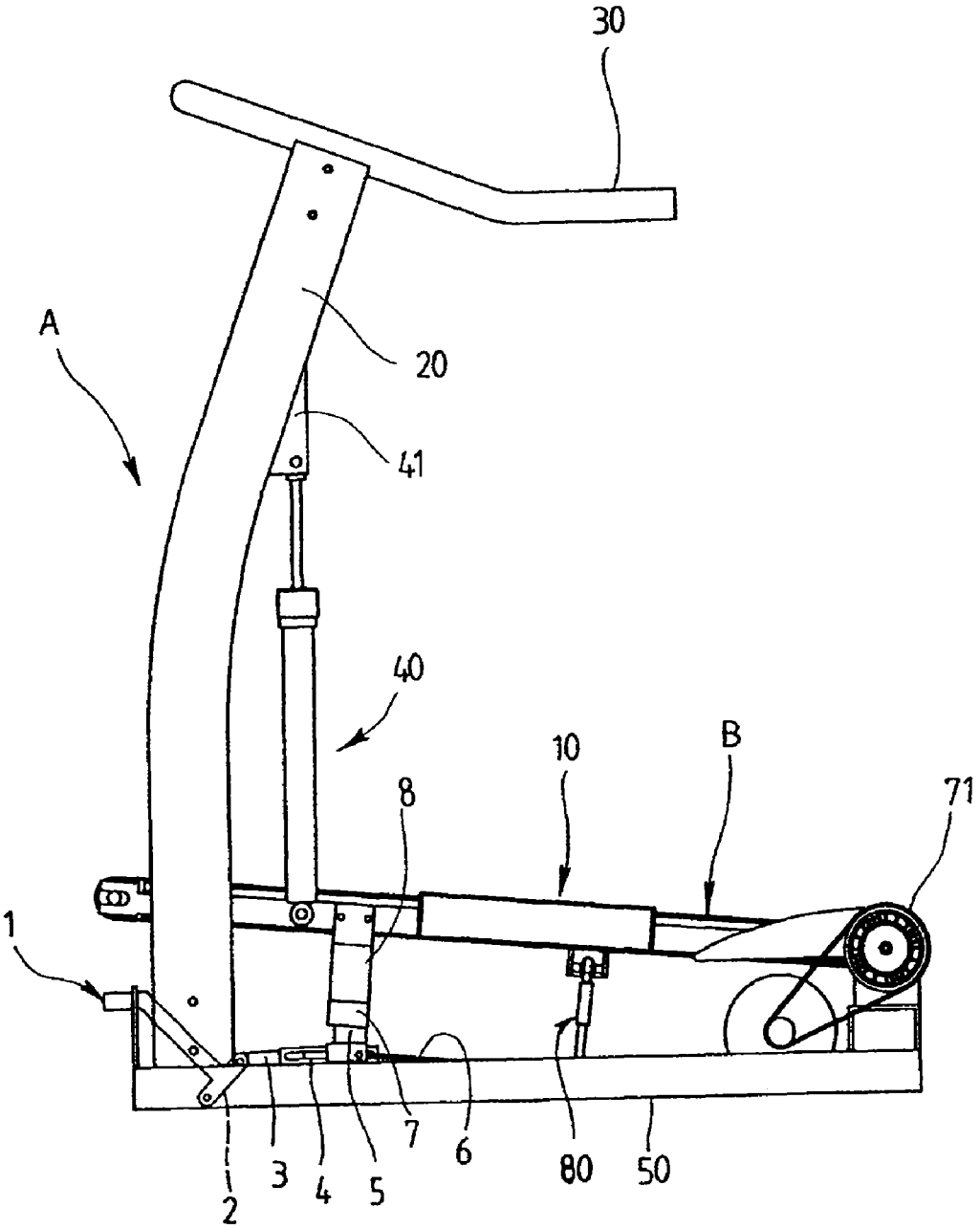
FIG.6 PRIOR ART
FIG. 6 is a side view to show a conventional combination of treadmill and stair climbing machine.
Figure 6A:
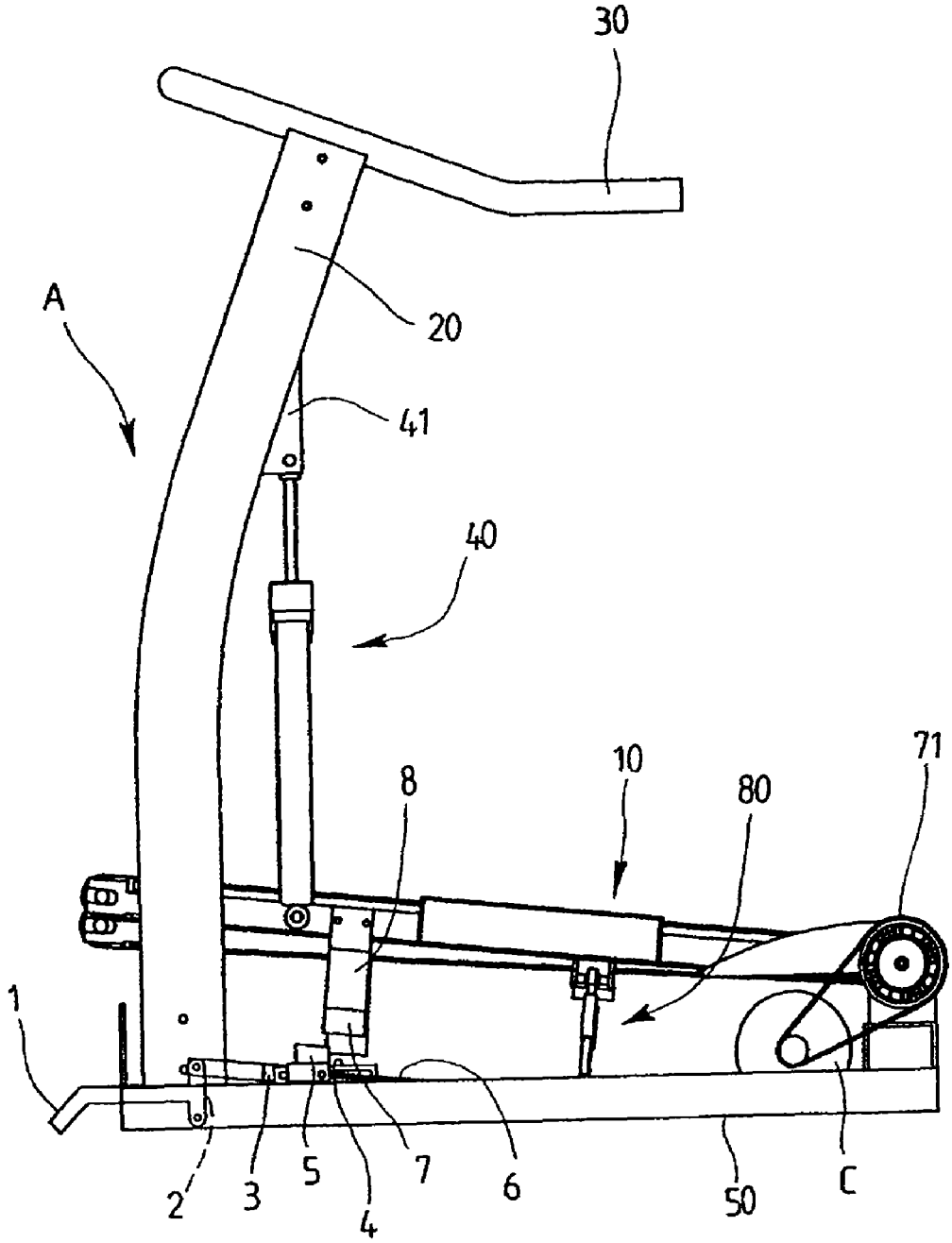
FIG.6A PRIOR ART
FIGS. 6A and 6B shows the frame and the two rollers of the conventional combination.
Figure 6B:
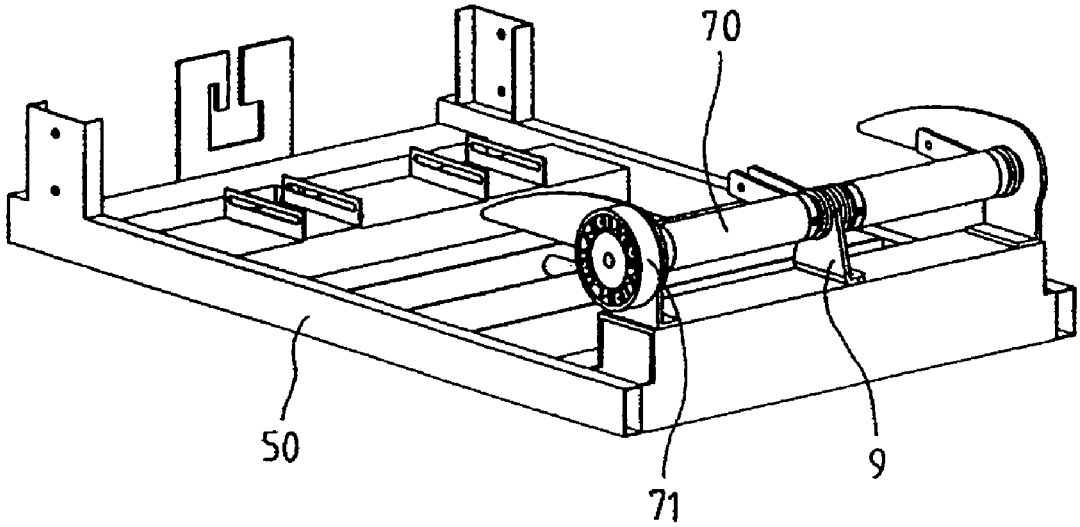
FIG.6B PRIOR ART
Figure 6C:
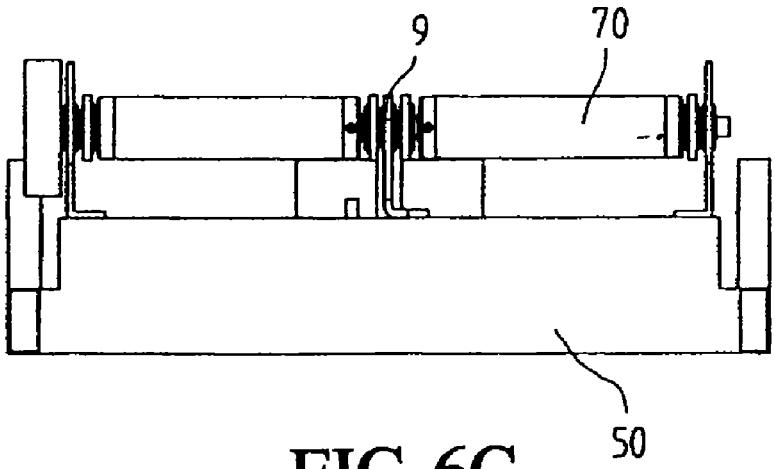
FIG.6C PRIOR ART
FIG. 6C shows the rear end view of the two rollers of the conventional combination.

Further referring to FIG. 4C, a swing mechanism 80 is pivotably connected to the frame 50 and the two pedals 10 so as to allow the two pedals 10 to be operated as a stair climbing machine. As shown in FIG. 5C, the swing mechanism 80 includes a main link 81 which has a intermediate point pivotably connected to a transverse bar 52 of the frame 50 and two sub-links 82 are respectively connected between the two ends of the main link 81 and two respective plates 83 connected to the two pedals 10.

The load of the pedals 10 are supported on the shaft 701 of the roller 70 and there is only one roller 70 so that the shortcoming of the conventional combination is improved. The operation of the switch member 61 is convenient to set the pedals 10 to be treadmill or stair climbing machine.

While we have shown and described the embodiment in accordance with the present invention, it should be clear to those skilled in the art that further embodiments may be made without departing from the scope of the present invention.

The invention claimed is:

1. A combination of treadmill and stair climbing machine, comprising:

a frame;

a roller rotatably supported by the frame;

a first pedal and a second pedal, each pedal pivotally connected with the frame and including a belt positioned about the roller;

an interconnection mechanism operably connecting the first pedal and the second pedal such that pivotal movement of the first pedal in a first direction is coordinated with pivotal movement of the second pedal in a second direction opposite the first direction;

a switch member pivotally connected with the frame, the switch member configured to be pivoted to a first position wherein the first and second pedals are locked in a fixed orientation relative to the frame;

a sub-frame connected to a side plate connected with frame;

a handle having a cam head pivotably connected to a pin which extends through the sub-frame and a first hole defined through the plate, a spring mounted on the pin and biased between the side plate and the sub-frame, the switch member having an extension which has a second hole defined therethrough, the pin being inserted in the second hole when the switch member is set in the first position.

2. A combination of treadmill and stair climbing machine, comprising:

a frame;

a roller rotatably supported by the frame;

a first pedal and a second pedal, each pedal pivotally connected with the frame and including a belt positioned about the roller;

an interconnection mechanism operably connecting the first pedal and the second pedal such that pivotal movement of the first pedal in a first direction is coordinated with pivotal movement of the second pedal in a second direction opposite the first direction;

a switch member pivotally connected with the frame, the switch member configured to be pivoted to a first position wherein the first and second pedals are locked in a fixed orientation relative to the frame; and wherein each pedal includes a tongue on an underside thereof and the switch member includes a block on a top thereof, each tongue including an inclined side which is rested on a top of the block when the switch member is set in the first position.

3. A combination of treadmill and stair climbing machine, comprising:

a frame;

a roller rotatably supported by the frame;

a first pedal and a second pedal, each pedal pivotally connected with the frame and including a belt positioned about the roller;

an interconnection mechanism operably connecting the first pedal and the second pedal such that pivotal movement of the first pedal in a first direction is coordinated with pivotal movement of the second pedal in a second direction opposite the first direction;

a switch member pivotally connected with the frame, the switch member configured to be pivoted to a first position wherein the first and second pedals are locked in a fixed orientation relative to the frame; and an L-shaped plate connected to the frame and each pedal having a connection plate which has two elongate holes, the L-shaped plate having two protrusions on each of two sides thereof, the two protrusions movably engaged with the two elongate holes of each connection plate.

4. An exercise device comprising:

a frame;

a first pedal pivotally supported on said frame and including a first belt;

a second pedal pivotally supported on said frame and including a second belt;

a roller rotatably supported on said frame, said first belt and said second belt are positioned about said roller;

a lockout mechanism connected with said frame, said lockout mechanism operable to lock said first and second pedals in a fixed orientation relative to said frame, said lockout mechanism including a switch member pivotally connected with said frame and adapted to selectively engage said first and second pedals and a spring connected with said switch member biased to hold said switch member in said horizontal position.

5. The exercise device of claim 4, wherein said exercise device functions as a treadmill when said switch member is in a tilted position.

6. The exercise device of claim 4, wherein said exercise device functions as a stair climbing machine when said switch member is in a horizontal position.

7. The exercise device of claim 4, further comprising:

a support structure connected between said frame and said first and second pedals near the roller, said support structure adapted to pivotally support said first pedal and said second pedal on said frame.

8. The exercise device of claim 7, said support structure comprising:

a first member connected with said first pedal;

a second member connected with said second pedal;

a third member connected with said frame; and wherein said first member and said second member are movingly supported by said third member, said first member is stationary relative to said first pedal, said second member is stationary relative to said second pedal, said third member is stationary relative to said frame.

9. The exercise device of claim 8, said support structure further comprising:

at least one protrusion extending from said third member;

at least one first slot in said first member adapted to receive said at least one protrusion;

at least one second slot in said second member adapted to receive said at least one said protrusion;

wherein said at least one first slot reciprocally moves relative to said at least one protrusion when said first pedal pivots relative to said frame; and wherein said at least one second slot reciprocally moves relative to said at least one protrusion when said second pedal pivots relative to said frame.

10. The exercise device of claim 7, said support structure comprising:

a first plate extending from said first pedal;

a second plate extending from said second pedal; and a third plate extending from said frame adapted to support said first plate and said second plate.

11. The exercise device of claim 10, said first and second plates each having slots adapted to receive protrusions extending from opposing sides of said third plate.

12. The exercise device of claim 11, wherein said slots are arcuate.

13. An exercise device comprising:

a frame;

a first pedal pivotally supported on said frame and having a first belt;

a second pedal pivotally supported on said frame and having a second belt;

a lockout mechanism connected with said frame and having a selectively operable switch member;

wherein when said switch member is placed in a first orientation, said first and second pedals are locked in a fixed position relative to said frame such that said exercise device can function as a treadmill; and wherein when said switch member is placed in a second orientation, said first and second pedals are able to pivot relative to said frame such that said exercise device can function as a stair climbing machine, said lockout mechanism further comprising a spring connected with said switch member and biased to hold said switch member in said second orientation.

14. The exercise device of claim 13, further comprising:

an interconnection mechanism connected with said frame; and wherein said interconnection mechanism is operably associated with said first pedal and said second pedal to cause said first and second pedals to pivot in opposite directions relative to each other.

15. The exercise device of claim 13, further comprising:

a first hydraulic cylinder connected with said first pedal and said frame; and a second hydraulic cylinder connected with said second pedal and said frame.

16. The exercise device of claim 13, wherein said switch member is pivotally connected with said frame and is adapted to engage said first and second pedals.

17. An exercise device comprising:

a frame;

a first pedal pivotally supported on said frame and having a first belt;

a second pedal pivotally supported on said frame and having a second belt;

a lockout mechanism connected with said frame and having a selectively operable switch member;

wherein when said switch member is placed in a first orientation, said first and second pedals are locked in a fixed position relative to said frame such that said exercise device can function as a treadmill; and wherein when said switch member is placed in a second orientation, said first and second pedals are able to pivot relative to said frame such that said exercise device can function as a stair climbing machine, said lockout mechanism further comprising:

a pin adapted to extend through a first hole in said frame and a second hole in said switch member to hold said switch member in said first orientation.

18. An exercise device comprising:

a frame;

a single rear roller;

a first pedal pivotally supported on said frame and including a belt and a front roller, with the belt disposed about and in contact with the front roller and the single rear roller;

a second pedal pivotally supported on said frame and including a belt and a front roller, with the belt disposed about and in contact with the front and the single rear roller; and a support structure configured to support said first pedal and said second pedal while allowing said first pedal and said second pedal to pivot during use of the exercise device;

wherein said support structure is connected between said frame and said first and second pedals, said support structure is adapted to pivotally support said first pedal and said second pedal on said frame, and said support structure comprises:

a first member connected with said first pedal;

a second member connected with said second pedal;

a third member connected with said frame, wherein said first member and said second member are movingly supported by said third member;

at least one protrusion extending from said third member;

at least one first slot in said first member adapted to receive said at least one protrusion; and at least one second slot in said second member adapted to receive said at least one said protrusion;

wherein said at least one first slot reciprocally moves relative to said at least one protrusion when said first pedal pivots relative to said frame; and wherein said at least one second slot reciprocally moves relative to said at least one protrusion when said second pedal pivots relative to said frame.

19. An exercise device comprising:

a frame;

a single rear roller;

a first pedal pivotally supported on said frame and including a belt and a front roller, with the belt disposed about and in contact with the front roller and the single rear roller;

a second pedal pivotally supported on said frame and including a belt and a front roller, with the belt disposed about and in contact with the front and the single rear roller; and a support structure configured to support said first pedal and said second pedal while allowing said first pedal and said second pedal to pivot during use of the exercise device;

wherein said support structure is connected between said frame and said first and second pedals, and said support structure is adapted to pivotally support said first pedal and said second pedal on said frame, said support structure comprising:

a first plate extending from said first pedal;

a second plate extending from said second pedal; and a third plate extending from said frame adapted to support said first plate and said second plate, said first and second plates each having slots adapted to receive protrusions extending from opposing sides of said third plate.

20. The exercise device of claim 19, wherein said slots are arcuate.

21. An exercise device comprising:

a frame;

a drive roller rotatably supported on said frame;

a first pedal including a first belt positioned about and in frictional contact with said drive roller;

a second pedal including a second belt positioned about and in frictional contact with said drive roller; and a support structure connected between said frame and said first second pedals near the drive roller, said support structure adapted to pivotally support said first pedal and said second pedal on said frame such that the first pedal and the second pedal pivot while being supported by the support structure during use of the exercise device, wherein said support structure comprises:

a first member connected with said first pedal;

a second member connected with said second pedal;

a third member connected with said frame;

at least one protrusion extending from said third member;

at least one first slot in said first member adapted to receive said at least one protrusion; and at least one second slot in said second member adapted to receive said at least one said protrusion;

wherein said first member and said second member are movingly supported by said third member;

wherein said at least one first slot reciprocally moves relative to said at least one protrusion when said first pedal pivots relative to said frame; and wherein said at least one second slot reciprocally moves relative to said at least one protrusion when said second pedal pivots relative to said frame.

22. An exercise device comprising:

a frame;

a drive roller rotatably supported on said frame;

a first pedal including a first belt positioned about and in frictional contact with said drive roller;

a second pedal including a second belt positioned about and in frictional contact with said drive roller; and a support structure connected between said frame and said first second pedals near the drive roller, said support structure adapted to pivotally support said first pedal and said second pedal on said frame such that the first pedal and the second pedal pivot while being supported by the support structure during use of the exercise device, said support structure comprising:

a first plate extending from said first pedal;

a second plate extending from said second pedal; and a third plate extending from said frame adapted to support said first plate and said second plate, said first and second plates each including slots adapted to receive protrusions extending from opposing sides of said third plate.

23. The exercise device of claim 22, wherein said slots are arcuate.

* * * * *